US006467717B1

(12) United States Patent
Pedicano et al.

(10) Patent No.: US 6,467,717 B1
(45) Date of Patent: Oct. 22, 2002

(54) PORTABLE DISPENSER FOR PRODUCTS SPUN ON A HOLLOW ROLL

(76) Inventors: Ernest Pedicano, 11 Hertford St., New Rochelle, NY (US) 10801; Gary Fores, 11 Hertford St., New Rochelle, NY (US) 10801

( * ) Notice: Subject to any disclaimer, the term of this patent is extended or adjusted under 35 U.S.C. 154(b) by 0 days.

(21) Appl. No.: 09/621,046

(22) Filed: Jul. 21, 2000

Related U.S. Application Data

(60) Provisional application No. 60/185,273, filed on Feb. 28, 2000.

(51) Int. Cl.[7] ..... B65H 23/08; B65H 16/04

(52) U.S. Cl. ..... 242/422.5; 242/588.2; 242/597.7

(58) Field of Search ..... 242/422.5, 588.2, 242/597.5, 597.6, 597.7, 588, 588.6; D6/522

(56) References Cited

U.S. PATENT DOCUMENTS

| | | | | | |
|---|---|---|---|---|---|
| 3,061,218 | A | * | 10/1962 | Moore | 242/422.5 |
| 4,067,510 | A | * | 1/1978 | McGonagle | 242/588.2 |
| 4,102,513 | A | * | 7/1978 | Guard | 242/588 |
| 4,248,391 | A | * | 2/1981 | Ness | 242/597.7 |
| 4,720,053 | A | * | 1/1988 | Vance | 242/597.7 |
| 5,490,625 | A | | 2/1996 | Myatt | |
| 5,788,136 | A | * | 8/1998 | Othman | 242/422.5 |
| 5,842,655 | A | * | 12/1998 | McCarthy | 242/597.7 |
| 5,941,476 | A | | 8/1999 | Copass | |
| D419,015 | S | | 1/2000 | Umemoto | |
| 6,012,572 | A | | 1/2000 | Heathcock et al. | |
| 6,012,605 | A | | 1/2000 | Miloscia | |
| 6,012,674 | A | | 1/2000 | Leeuwenburgh | |
| 6,015,125 | A | | 1/2000 | Fischer | |
| 6,027,002 | A | | 2/2000 | Granger | |
| 6,027,069 | A | * | 2/2000 | Huang | 242/588.2 |

FOREIGN PATENT DOCUMENTS

| | | | | |
|---|---|---|---|---|
| EP | 0300695 | * | 1/1989 | 242/588.2 |
| GB | 2065070 | * | 6/1981 | 242/588.2 |

* cited by examiner

*Primary Examiner*—John M. Jillions
(74) *Attorney, Agent, or Firm*—Handal & Morofsky

(57) ABSTRACT

A device for dispensing a web of material wrapped around a hollow core, comprising a base having a support member and an arm. The support member is inserted into the hollow core and rotatably seated on the base in such a manner as to freely allow rotational movement.

24 Claims, 6 Drawing Sheets

PORTABLE DISPENSER FOR PRODUCTS SPUN ON A HOLLOW ROLL

This application claims the benefit of provisional application No. 60/185,273 filed in Feb. 28, 2000.

STATEMENT REGARDING FEDERALLY SPONSORED RESEARCH OR DEVELOPMENT (Not applicable.)

BACKGROUND OF THE INVENTION

The present invention relates to a portable device for dispensing products contained on a roll, such as paper towels, wrapping paper, material, toilet paper and the like. More particularly, the present invention relates to a dispensing device which holds the roll of product to be dispensed at one end, orients the roll in a vertical manner, and is portable. In this manner, the device may be placed on a horizontal surface for use.

Several products commonly used in the household are purchased wound in a roll on a core, typically a cardboard type of core. Products like this include paper towels, toilet paper, disposable plastic bags and other transversely perforated products, as well as some roll products which are not transversely perforated, such as wax paper and plastic, wrapping film. While these products are often placed in a dispenser or hung from a surface so that the axis of the central core is horizontally oriented, in some circumstances it is both functionally required and/or aesthetically pleasing to have the product available in a vertical orientation of the core axis, particularly with one end of the dispenser resting on a horizontal surface, such as a kitchen counter. Furthermore, it is functional and aesthetic improvement, among other things, to have a dispensing device that does not hold the product roll at both ends or require a shaft for the roll to rotate on yet still provides rotational movement of the roll.

BRIEF SUMMARY OF THE INVENTION

The present invention provides an aesthetically pleasing and functionally efficient portable device for receiving a roll of product wound on a central core, retaining the product in a vertical orientation, allowing rotational motion and making the product readily dispensable to a user. The device comprises a base and an arm, with a support member seated rotatably on the base. Preferably, the support member has core engagement members, that is, notches, ribs, extensions, or similar attachments which further aid in tightly securing the core onto the support member. The arm extends from the base in a manner which does not inhibit the operation of the device.

One of the many advantages of this device is that it may be moved to any desired location and can stand on its own. However, the device may also be secured at a location in any position, temporarily or. permanently, using conventional mounting techniques, i.e., clamps, brackets, adhesives, etc.

A preferred embodiment further comprises a vertically protruding extension from the upper surface of the base. The support member is seated on the protruding extension, in a fashion similar to a bearing, thus enabling rotational motion of the support member. Preferably, the arm extends horizontally away from the base before reaching an elbow, thus changing the direction of the arm so that it extends vertically upward. The device may include a gripping or locking mechanism for holding, preventing unraveling or further securing the roll of product.

BRIEF DESCRIPTION OF THE SEVERAL VIEWS OF THE DRAWING

One or more embodiments of the invention and of making and using the invention, as well as the best mode contemplated of carrying out the invention, are described in detail below, by way of example, with reference to the accompanying drawings, in which.

DETAILED DESCRIPTION OF THE INVENTION

Figure 2:
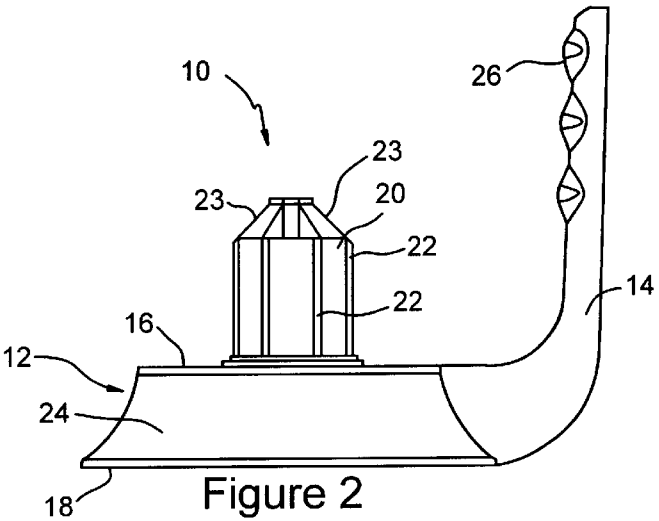
FIG. 2 is a side view of the embodiment shown in FIG. 1.
Figure 4:
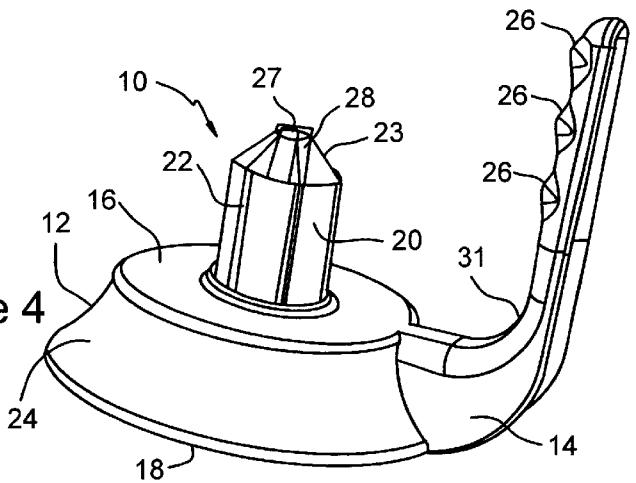
FIG. 4 is a perspective view of the embodimentin FIG. 1.
Figure 1:
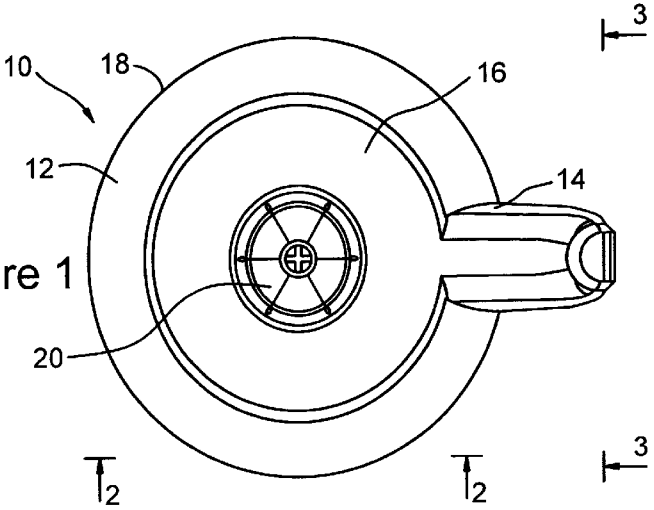
FIG. 1 is a top view of a preferred embodiment of the inventive device.
Figure 3:
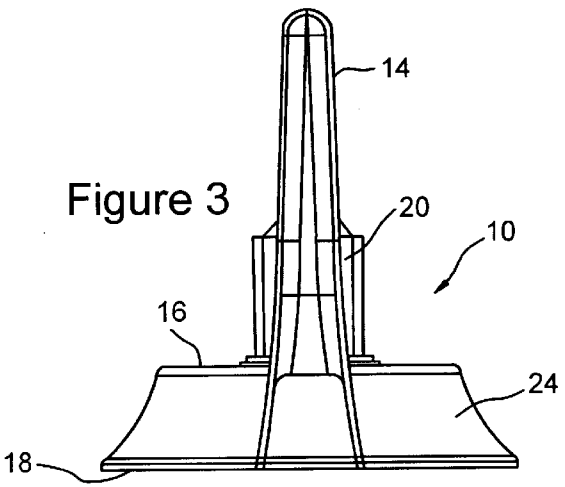
FIG. 3 is a rear view of the embodiment shown in FIG. 1.
Figure 6:
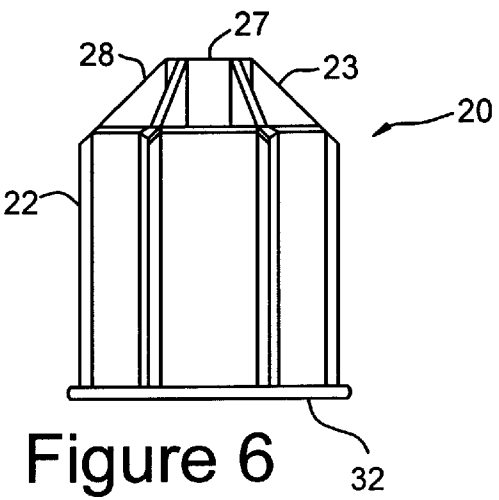
FIG. 6 is a perspective view of an embodiment of the support member of the inventive device.

The following more detailed description of the invention is intended to be read in the light of, or in context with, the preceding summary and background descriptions. Unless otherwise apparent, or stated, directional references, such as "up", "down", "left", "right", "front" and "rear", are intended to be relative to the orientation of a particular embodiment of the invention as shown in the first numbered view of that embodiment. Also, a given reference numeral indicates the same or a similar structure when it appears in different figures.

Although the present invention is not limited to paper towel rolls, but extensible to many other rolls of product, paper towel rolls are utilized in practicing the invention in the illustrated embodiments. The alternative embodiment of the inventive device which uses paper towel rolls are also used herein as a convenient vehicle for illustrating aspects, features, and characteristics of the invention. Furthermore, the advantages of using the inventive device for marketing or advertising of a specific trademark or manufacturer are contemplated by the present invention herein.

FIGS. 1–9 illustrate one embodiment of the present invention. The dispenser 10 comprises a base 12, and an arm 14 extending from base 12. Base 12 further comprises an upper surface 16 and a lower surface 18. Arm 14 extends horizontally outward and then vertically upwardly, essentially normal to an upper surface 16 of base 12. Both surfaces 16 and 18 are preferably substantially flat, round and parallel to each other. Preferably, base 12 has a diameter which increases generally from upper surface 16 to lower surface 18. Preferably, lower surface 18 has a diameter larger than the maximum diameter of the product roll 19 to be dispensed thereupon.

Base 12 and arm 14 are preferably comprised of plastic, but other suitable materials including metals and polymeric materials may be utilized.

Despencer 10 may be molded in one mold, that is, making base 12 and arm 14 simultaneously in an injection mold. In the illustrated embodiment, base 12 and arm 14 are hollow, molded plastic. Therefore, base 12 is frustro-conical, and lower surface 18 is comparable to a ring, except that it breaks to form arm 14. This formation is best viewed in FIG. 8.

Support member 20 is rotatably fitted on upper surface 16 of base 12. Preferably, support member 20 is snap-fit onto a vertical extension 30 from base 12 which is substantially normal to upper surface 16. Upper surface 16 and vertical extension 30 are configured such that support member 20 may rotate freely once engaged. Preferably, vertical extension 30 does not extend far from upper surface 16, only enough to accommodate support member 20. With its hollow plastic design the present invention is smaller and uses less material than prior art dispensers which hold a roll of product at both ends.

Figure 9:
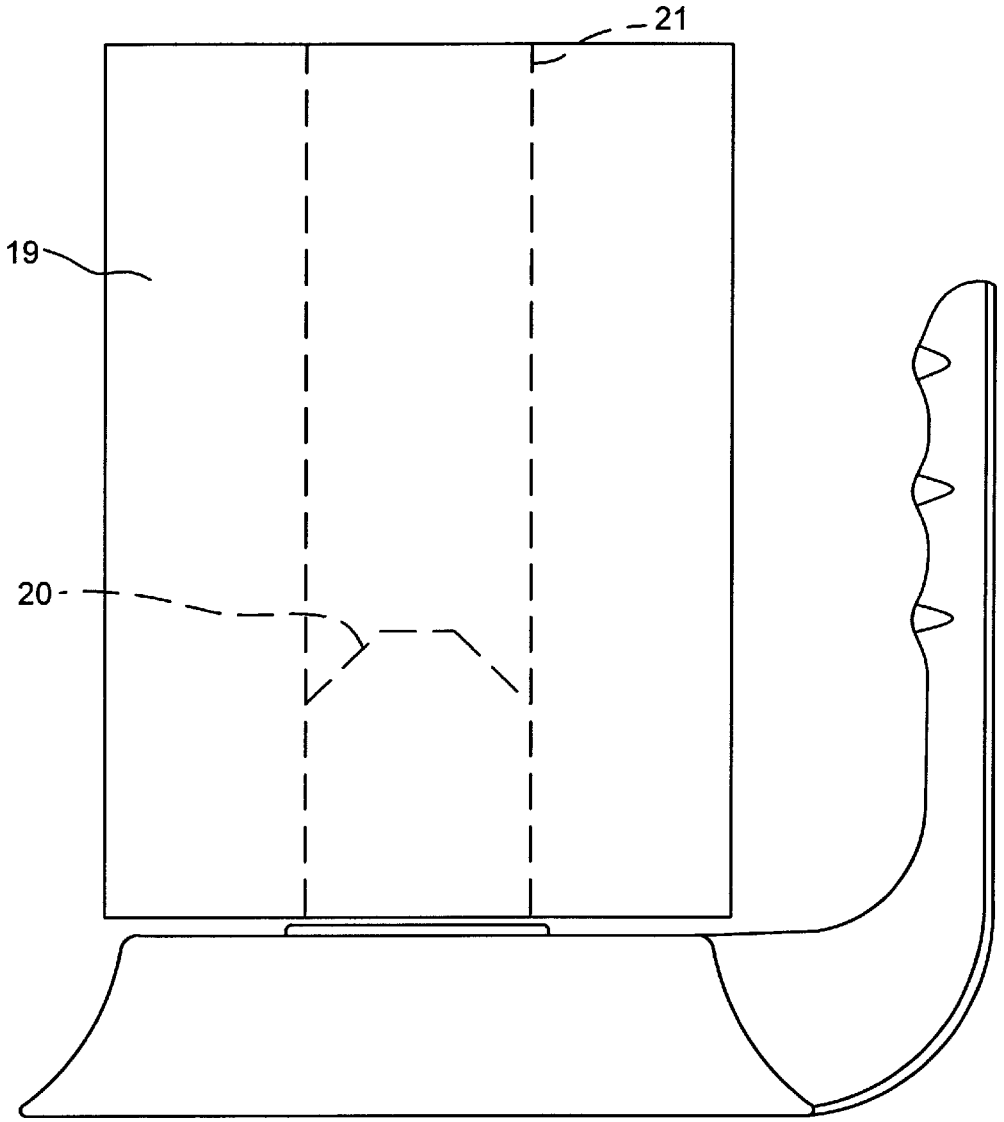
FIG. 9 is a side view of the embodiment shown in FIG. 1 with a paper towel roll placed on the support member.

As illustrated in FIG. 9, hollow core 21 roll of product 19 would be inserted onto support member 20, which further comprises core engagement members 22 and 23. Core engagement members 22 and 23 contact the inner surface of hollow core 21 and provide added support in securing the roll of product 19 onto support member 20. Support member 20 is rotatably fitted so it would spin when a user pulls the end sheet of rolled product 19.

Preferably, support member 20 is generally configured to come to a point 27, having a top end 28 of smaller diameter than the portion below. Core engagement members 22 and 23 also extend along the outer surface of support member 20 up to top 28. This design aids the user in fully inserting support member 20 into a partially or fully crushed roll, among other things.

Support member 20 preferably comprises six core engagement members 22 and 23 which extend from top end 28 to bottom end 32 of support member 20.

Figure 5:
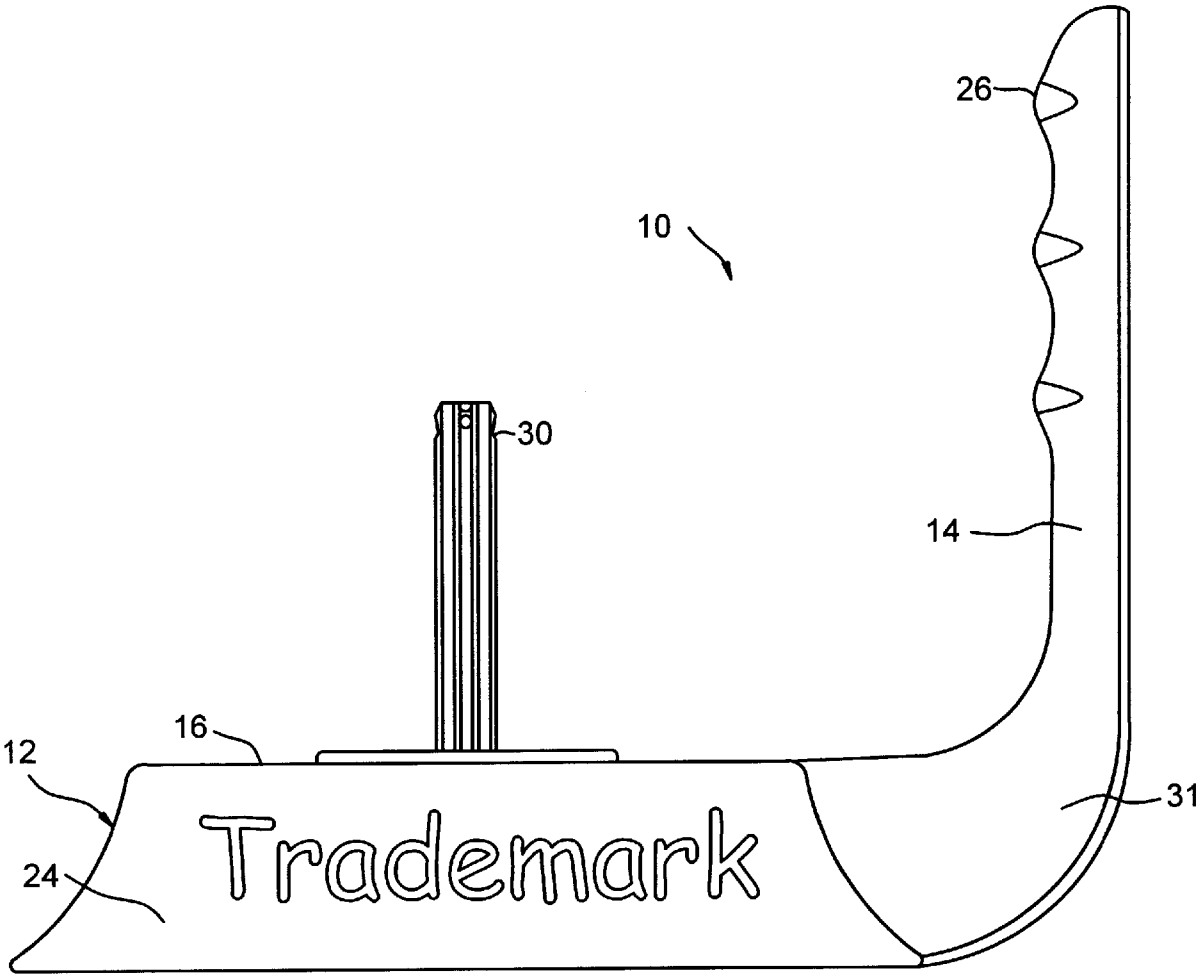
FIG. 5 is a perspective view of the inventive device.
Figure 7:
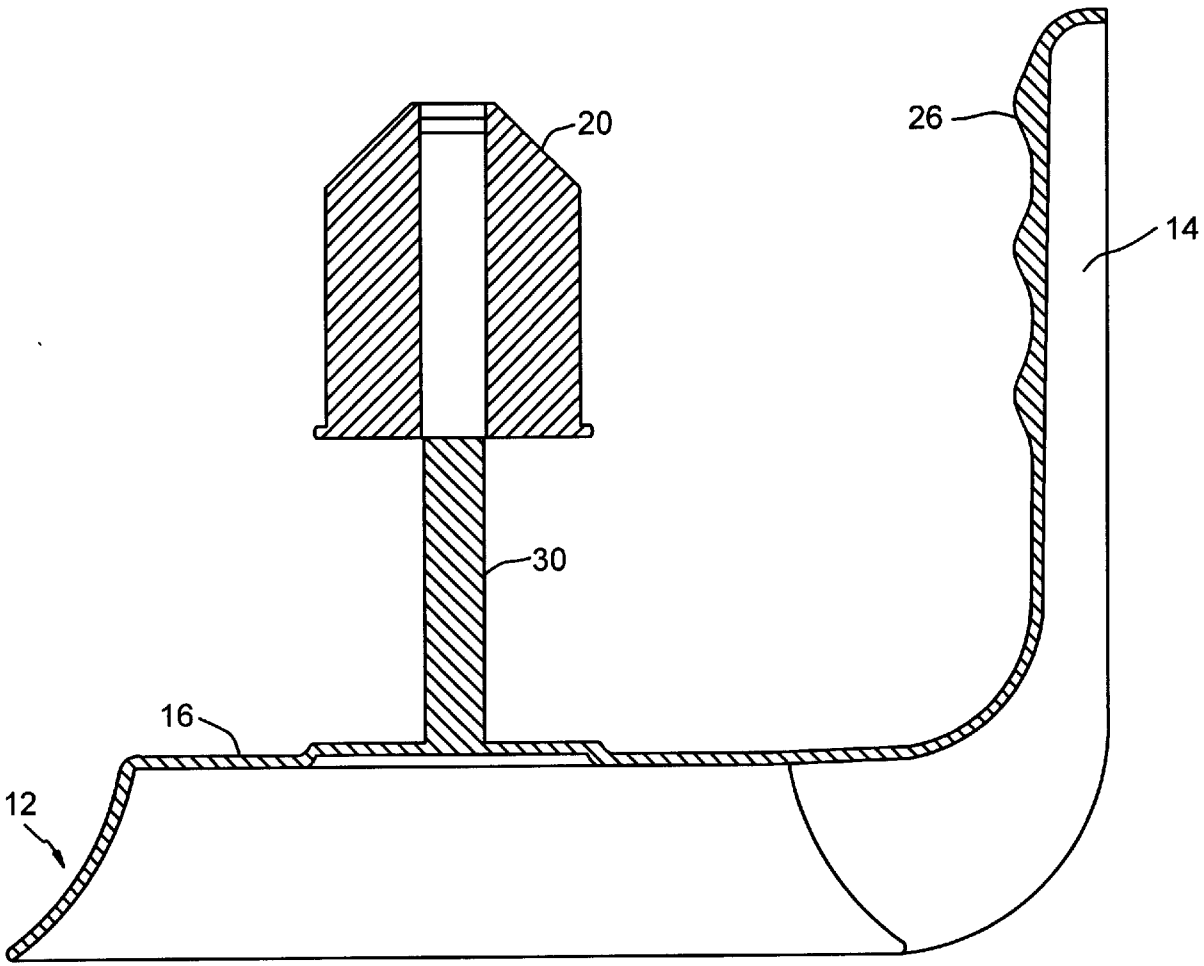
FIG. 7 is a perspective view of an embodiment of the inventive device without the support member.
Figure 8:
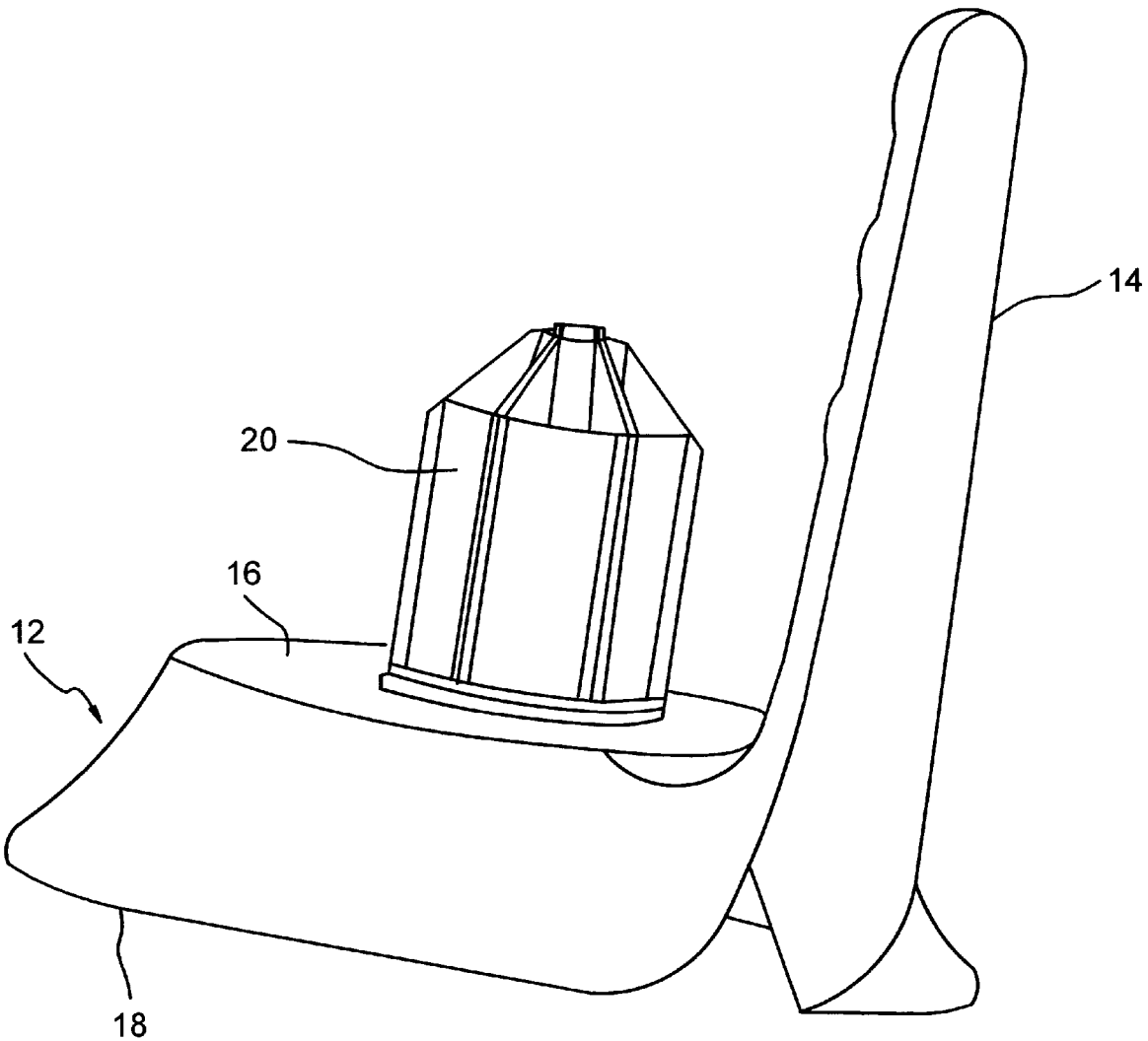
FIG. 8 is rear perspective view of the inventive device.

In FIG. 5, the word "Trademark" is illustrated on sidewall 24 of base 12 as an example of an advantageous location for the placement of printed matter, such as promotional or product-identifying material. Preferably, there is a slight curvature in sidewall 24, between lower surface 18 and upper surface 16.

The elbow 31 in arm 14, which provides added space for gripping arm 14 while also allowing the present invention to accommodate large rolls of product 19, is further illustrated in this embodiment as having three indentations 26. Indentations 26 provide the user with a comfortable location to grip arm 14.

In FIG. 5, support member 20 is removed from dispenser 10, thus revealing vertical extension 30 from the upper surface 16 of base 12. Support member 20 is inserted on and preferably snap-fits onto extension 30 in a manner such that support member 20 freely rotates when a force is applied to roll 19, i.e., when a user pulls the last sheet of roll of product 19 seated on support member 20.

Figure 10:
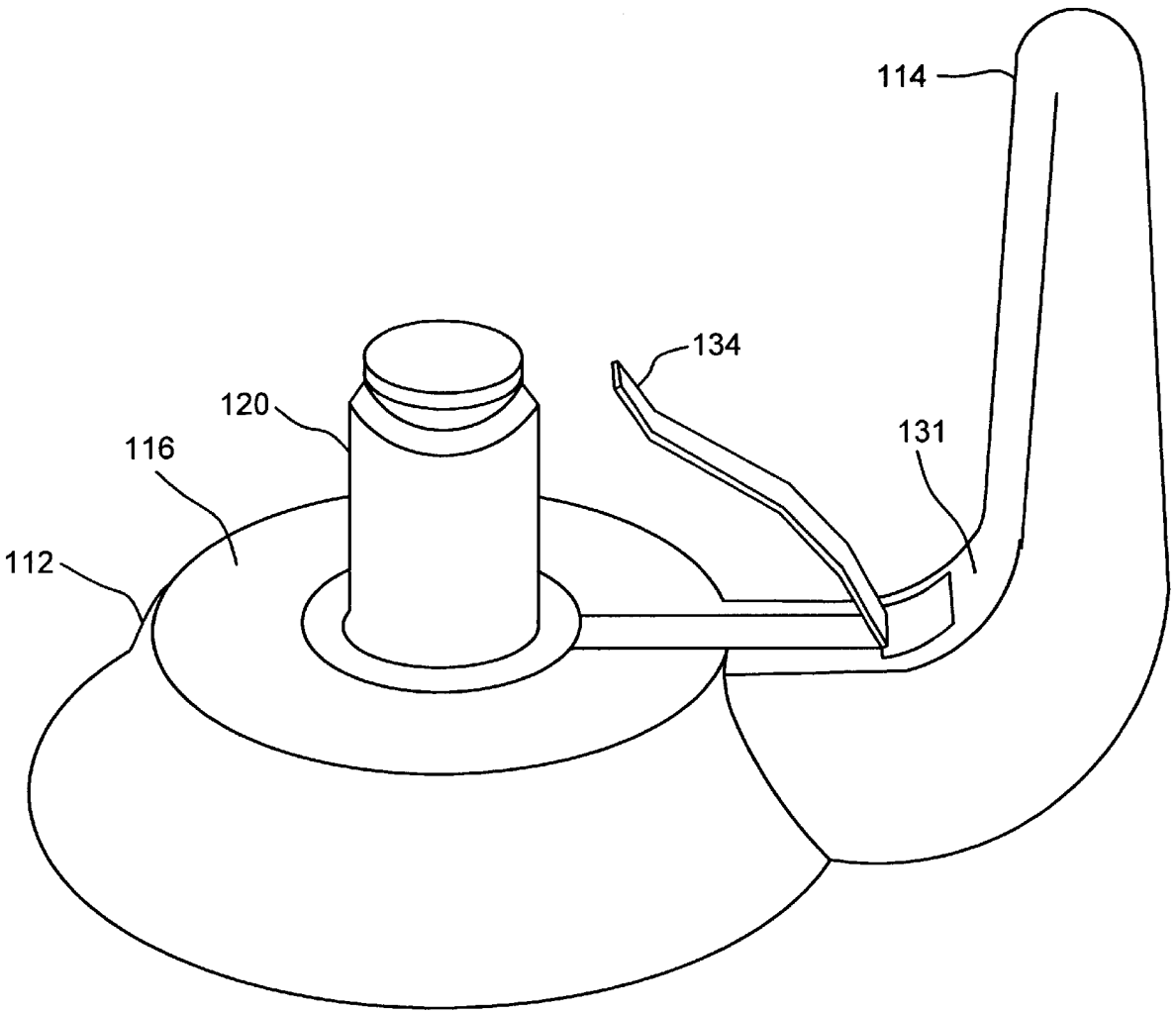
FIG. 10 is a perspective view of another embodiment of the present invention.

FIG. 10 illustrates another embodiment of the present invention. Dispenser 110 further comprises gripping member 134. In this embodiment, gripping member 134 comprises a bar with a slight curvature which extends in the direction of base 112 from an area near elbow 131 of arm 114, thus applying pressure on a roll of product placed on support member 120. Gripping member 134 pushes against the roll of product in a manner which further secures the roll and prevents unraveling without impeding the rotational motion associated with the typical exertion of force applied on the roll when its outermost piece is pulled. Also, in this embodiment, arm 114 is hollow but fully-rounded.

While illustrative embodiments of the invention have been described above, it is, of course, understood that various modifications will be apparent to those of ordinary skill in the art. Many such modifications are contemplated as being within the spirit and scope of the invention.

What is claimed is:

1. A device for disposing a roll of paper towing wrapped around a hollow core, the device comprising:

(a) a base having an upper portion defining a mounting surface to support said roll, said base having a lower surface with an extent greater than the extent of said portion of said mounting surface;

(b) a shaft extending from said upper portion of said base in a direction away from said lower surface;

(c) an arm extending from said base to provide a handle for grasping said device; and (d) a support member seated rotatably on said shaft and configured to be received in said hollow core and support said paper towel roll;

wherein said base, shaft and arm comprise a single member of unitary construction.

2. A device as in claim 1, wherein said support member has an outer surface and further comprises core engagement members protruding from said outer surface of said support member.

3. A device as in claim 1, wherein a portion of said arm further comprises a plurality of grooves generally configured to correspond to the grip of a human hand.

4. A device as in claim 1, wherein said base further comprises a side wall joining said mounting surface and said lower surface and having an outer surface and inner surface, wherein said side wall has printed text disposed on said outer surface.

5. A paper towel holder as in claim 1, further comprising a tensioner integral with said base.

6. A paper towel holder as in claim 5, wherein said arm and said base are integral with each other.

7. A device as claimed in claim 1, wherein said hollow core is secured to said support member ordy at one end of said hollow core.

8. A device for dispensing a web of material wrapped around a hollow core, the device comprising:

(a) a base having an upper surface;

(b) a shaft extending vertically from said upper surface of said base;

(c) an arm having a first end and a second end, said first end being attached to said base;

(d) a support member seated rotatably on said shaft, said support member being configured to engage said hollow core; and (e) a tensioner formed integrally with said base;

wherein said base, shaft and arm comprise a single member of unitary construction.

9. A device as in claim 8 wherein said support member snap-fits onto said shaft and is capable of supporting a paper towel holder.

10. A device as in claim 8, wherein said support member further comprises a plurality of core engagement members protruding from said outer surface of said support member.

11. A device as in claim 10, wherein said core engagement members comprise strips, said strips being substantially perpendicular to said upper surface of said base.

12. A device as in claim 8, wherein said upper and lower surfaces are substantially circular.

13. A device as in claim 12, wherein the basal diameter of said base is greater than or equal to the basal diameter of said upper surface.

14. A paper towel holder as in claim 8, wherein said arm is formed integrally with said base, said shaft and said tensioner.

15. A paper towel holder as in claim 8, wherein said shaft defines a substantially vertical surface along more than 50 percent of its height.

16. A paper towel holder as in claim 8, wherein said shaft defines a substantially vertical surface long enough to support a paper towel roll.

17. A device for dispensing a web of paper toweling wrapped around a hollow core, said hollow core having a diameter, the device comprising:

(a) a base member having an upper surface;

(b) a shaft extending vertically from said upper surface of said base;

(c) an arm integrally formed with said base having a first end and a second end, said first end being attached to and integral with said base; and (d) a support member seated rotatably on said upper surface of said base defining a shaft configured to engage said hollow core;

wherein said base, shaft and arm comprise a single member of unitary construction.

18. A device as in claim 17, wherein the basal diameter of said support member is greater than or equal to said diameter of said paper toweling prior to its being used.

19. A device as in claim 17, wherein said arm and support member are fabricated from plastic.

20. A device as in claim 17, wherein said outer surface of said device further comprises printed text.

21. A device as in claim 17, wherein said arm extends horizontally and vertically from said base.

22. A paper towel holder as in claim 17, wherein said shaft defines a substantially vertical surface along more than 50 percent of its height.

23. A device for dispensing a roll of paper toweling wrapped around a hollow core, comprising:

(a) a base having an upper portion defining a mounting surface, said base having a lower surface with a diameter greater than the diameter of said portion of said mounting surface adapted to support said roll;

(b) an arm extending from said base to provide a handle for grasping said device;

(c) a support member seated rotatably on at least a portion of said upper surface and configured to engage and support said hollow core, at least a portion of said mounting surface being adapted to support said support member; and (d) a tensioner integral with said base, wherein said tensioner comprises a leaf spring, having a base region adjacent to said base and tip region at the end of said leaf spring opposite said base region extending from said base upwardly and curving toward said support member in said base region of said tensioner adjacent said base and bending in a direction closer to the vertical along the length of said tip region extending from the portion of said tip region closest to said base in a direction toward the tip of said tip region.

24. A device for dispensing a web of material wrapped around a hollow core, comprising:

(a) a base having an upper surface;

(b) a shaft extending vertically from said upper surface of said base;

(c) an arm having a first end and a second end, said first end being attached to said base;

(d) a support member seated rotatably on said shaft, said support member being configured to engage said hollow core; and (e) a tensioner formed integrally with said base, wherein said tensioner comprises a leaf spring, having a base region adjacent said base and a tip region at the end of said leaf spring opposite said base region extending from said base upwardly and curving toward said support member in said base region of said tensioner adjacent said base and bending in a direction closer to the vertical along the length of said tip region extending from the portion of said tip region closest to said base in a direction toward the tip of said tip region.

* * * * *